US006523507B2

(12) United States Patent
Schmitz et al.

(10) Patent No.: US 6,523,507 B2
(45) Date of Patent: Feb. 25, 2003

(54) FAN SHROUD WITH SNAP-ON COOLANT BOTTLE

(75) Inventors: Gregory E. Schmitz, Sherwood, WI (US); Jerry R. Reineking, Cleveland, WI (US); Jeffrey L. Bracht, Cascade, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/910,369

(22) Filed: Jul. 20, 2001

(65) Prior Publication Data

US 2003/0015152 A1 Jan. 23, 2003

(51) Int. Cl.[7] ..... F01P 9/04

(52) U.S. Cl. ..... 123/41.55; 123/195 A; 165/41

(58) Field of Search ..... 123/41.1, 41.44, 123/41.55, 41.49, 41.14, 41.57, 41.33, 195 A; 165/41, 122, 121, 916, 51, 140; 220/203

(56) References Cited

U.S. PATENT DOCUMENTS

| | | | | |
|---|---|---|---|---|
| 3,692,004 A | | 9/1972 | Tangue et al. | |
| 3,757,984 A | | 9/1973 | Barton | |
| 4,787,445 A | | 11/1988 | Howcroft | |
| 5,000,333 A | | 3/1991 | Petrelli | |
| 5,456,218 A | | 10/1995 | Theorell | |
| 5,649,587 A | * | 7/1997 | Plant | 165/41 |
| 5,722,559 A | | 3/1998 | Branham | |
| 5,931,228 A | * | 8/1999 | Kalbacher et al. | 165/916 |
| 6,026,974 A | * | 2/2000 | Burt | 220/564 |
| 6,041,744 A | * | 3/2000 | Oota et al. | 123/41.49 |
| 6,145,479 A | | 11/2000 | Rotter | |
| 6,189,492 B1 | | 2/2001 | Brown | |

FOREIGN PATENT DOCUMENTS

| | | | | |
|---|---|---|---|---|
| JP | 402181018 A | * | 7/1990 | F01P/11/00 |

* cited by examiner

*Primary Examiner*—Carl S. Miller
(74) *Attorney, Agent, or Firm*—Quarles & Brady LLP

(57) ABSTRACT

A fan shroud for an internal combustion engine includes a snap-on detachable overflow bottle. The fan shroud has a fan opening and a unitary bottle mount with a deflectable bottle clip with a latch end that engages a groove in the overflow bottle. The mount includes an opposite side with an inwardly directed locking surface that engages a recess in a side face of the overflow bottle. The overflow bottle is held upright and secured to the fan shroud by snapping it into the bottle mount.

10 Claims, 5 Drawing Sheets

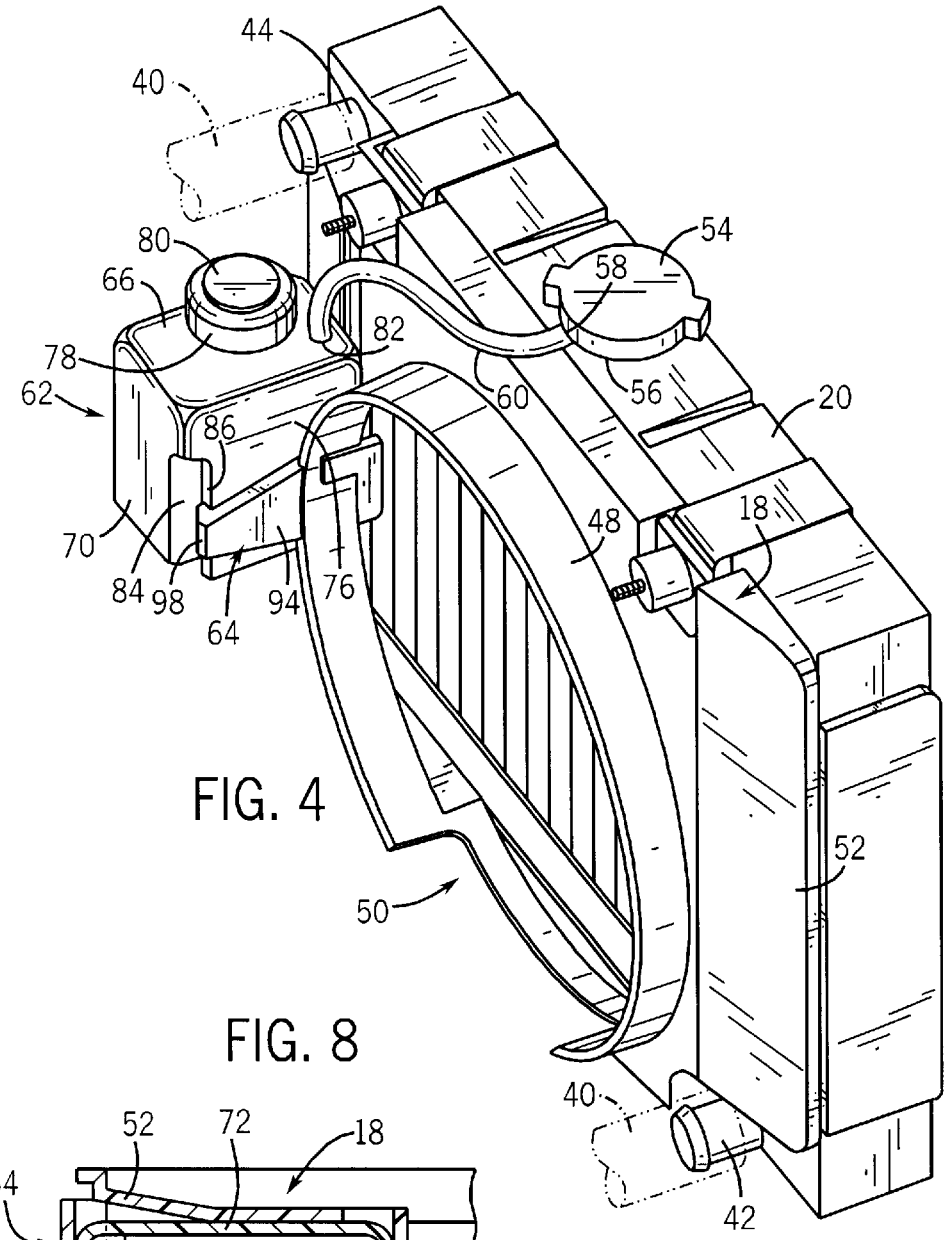
FIG. 4
FIG. 8
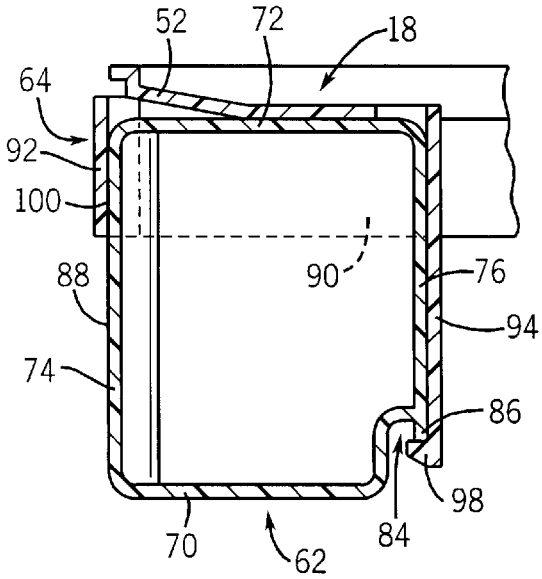

FAN SHROUD WITH SNAP-ON COOLANT BOTTLE

CROSS-REFERENCE TO RELATED APPLICATIONS

Not applicable.

STATEMENT REGARDING FEDERALLY SPONSORED RESEARCH/DEVELOPMENT

Not applicable.

FIELD OF THE INVENTION

The invention relates to engine coolant systems. More particularly, the invention relates to an improved mounting arrangement for a coolant overflow container.

BACKGROUND OF THE INVENTION

Liquid cooled internal combustion engines circulate coolant fluid through one or more cooling circuits having conduit connected to a radiator to cool heat generating components of the engine, such as the cylinders. Coolant fluid expands in volume from heat picked up from the engine. The coolant system therefore must release the additional volume by evacuating it or accommodating it in an expansion or overflow container. The latter option is preferred in that it does not waste the coolant by dumping it to the surrounding environment.

Expansion or overflow containers are commonly used in the cooling circuit of internal combustion engines. The containers are typically connected to the highest point of the radiator, such as the fill cup, by suitable tubing. The containers are commonly mounted near the radiator by a bracket secured in place by threaded fasteners. This requires manufacture and assembly of the mounting hardware and either permanently mounts the container or requires tools to remove it. In the event the container needs to be replaced, it will thus first need to be dismounted.

It is desirable to keep the overflow container near the radiator to minimize tubing and thereby potential leakage from damaged or corroded tubing. Neighboring components, such as the fan and fan shroud, are ordinarily not suited for mounting the overflow container. The fan is revolving and the fan shroud is ordinarily sandwiched between the radiator and the cylinder block and thus cannot accommodate an overflow container.

U.S. Pats. 3,692,004 and 6,189,492 B1 disclose fan shrouds with integral fluid reservoirs or receptacles such that separate assembly is not required. In these patents, however, the fan shrouds are molded to include the fluid receptacles in a unitary structure. Thus, if a receptacle was punctured or cracked so that fluid leaked, the entire fan shroud would need to be replaced, thus resulting in considerable waste and expense. Also, the fan shroud would need to be disassembled from the radiator, which is more difficult than removing only a separate coolant container. Moreover, the overflow receptacles are molded of the same material as the fan shroud body, which is typically a more rigid and costly plastic.

SUMMARY OF THE INVENTION

The invention provides a fan shroud with a mount for a detachable overflow bottle for use in the cooling circuit of an internal combustion engine.

Specifically, in a liquid cooled internal combustion engine having a fan, a radiator containing coolant fluid pumped through a cooling circuit for cooling heat generating components of the engine, and a fan shroud disposed about the fan to direct air from the fan to the radiator for cooling the coolant, the invention provides for the fan shroud to include a bottle mount detachably mounting an overflow bottle that is connectible to the radiator to receive coolant. The bottle mount is preferably integral with the unitary part of the fan shroud.

In one form, the bottle mount includes a deflectable bottle clip with a latch end for engaging the overflow bottle in a snap fit. The bottle mount forms a cradle for supporting the bottom and sides of the overflow bottle. The cradle has a planar base extending between spaced sides.

The shroud body further includes a fan-receiving flange along the periphery of the fan opening. The flange forms a part of one of the sides of the bottle mount. The opposite side of the mount includes an inwardly projecting, preferably convex, locking surface for retaining the overflow bottle in the bottle mount. The shroud body tapers down at the outward ends and forms a recess at the bottle mount sized to accommodate a portion of the overflow bottle.

Another aspect of the invention is an overflow coolant bottle for mounting to the fan shroud. The coolant bottle is constructed to snap into, and be detachable from, the bottle mount of the fan shroud. Specifically, the coolant bottle has a bottom joined to a top by side walls defining front, back and opposite side faces. The front face includes a recess sized to engage the bottle clip of the bottle mount and one of the side faces includes a recess extending from the front face to the back face for engaging the locking feature of the bottle mount.

The invention thus provides a one-piece fan shroud and bottle mount for securing a specially designed overflow bottle for accommodating excess engine coolant. The overflow bottle can be easily installed and removed from the shroud without tools. No assembly is required for the mount to the fan shroud and the overflow bottle can simply be snapped into the bottle mount from the front of the bottle mount to secure it in an upright position. The overflow bottle can also be disengaged and removed from the fan shroud easily by pushing the bottle clip outward. The fan shroud can be mounted to the radiator so that the bottle mount is close to the radiator fill opening, thus minimizing the required overflow tubing.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

FIG. 4 is a perspective view of the fan shroud with the overflow bottle snapped into a bottle mount, the fan shroud is shown mounted to a radiator of the internal combustion engine;

FIG. 8 is a cross-section along line 8—8 of FIG. 5.

DETAILED DESCRIPTION OF THE PREFERRED EMBODIMENT

Figure 1:
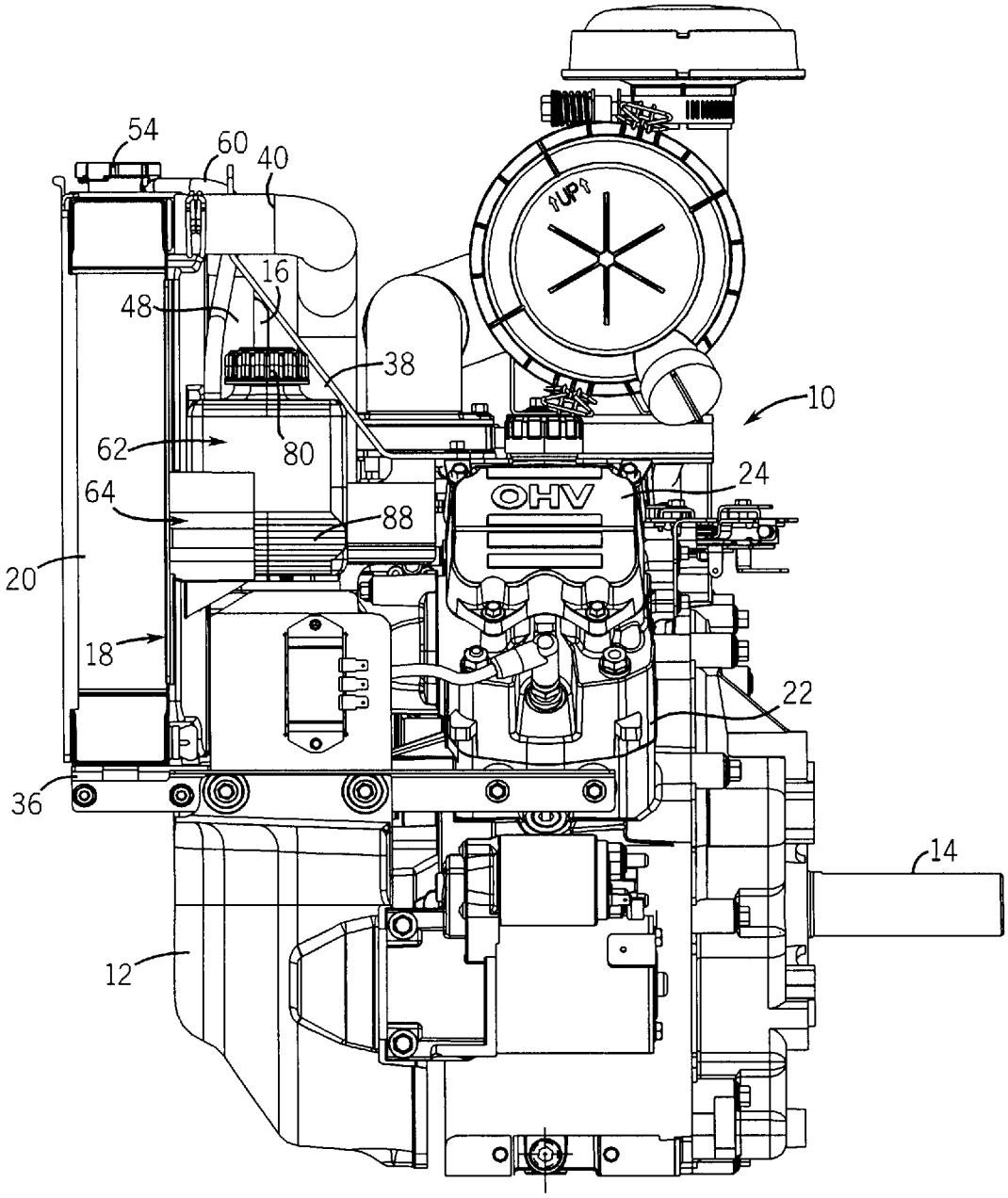
FIG. 1 is a side elevation view of an internal combustion engine having the fan shroud and overflow bottle assembly of the present invention.
Figure 3:
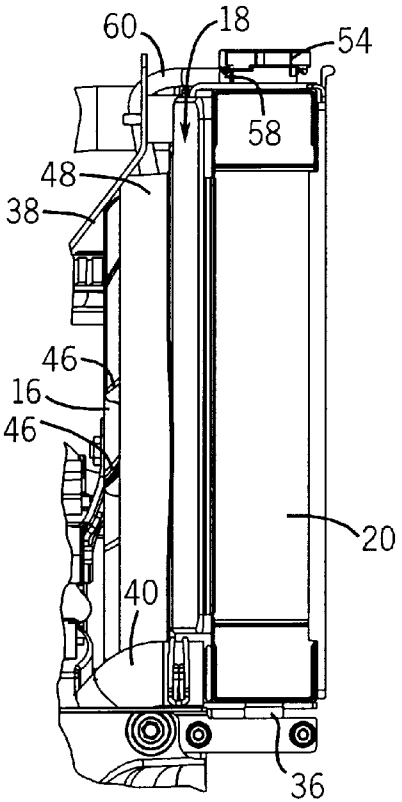
FIG. 3 is a partial side view of the radiator and fan shroud of the internal combustion engine of FIG. 1.
Figure 2:
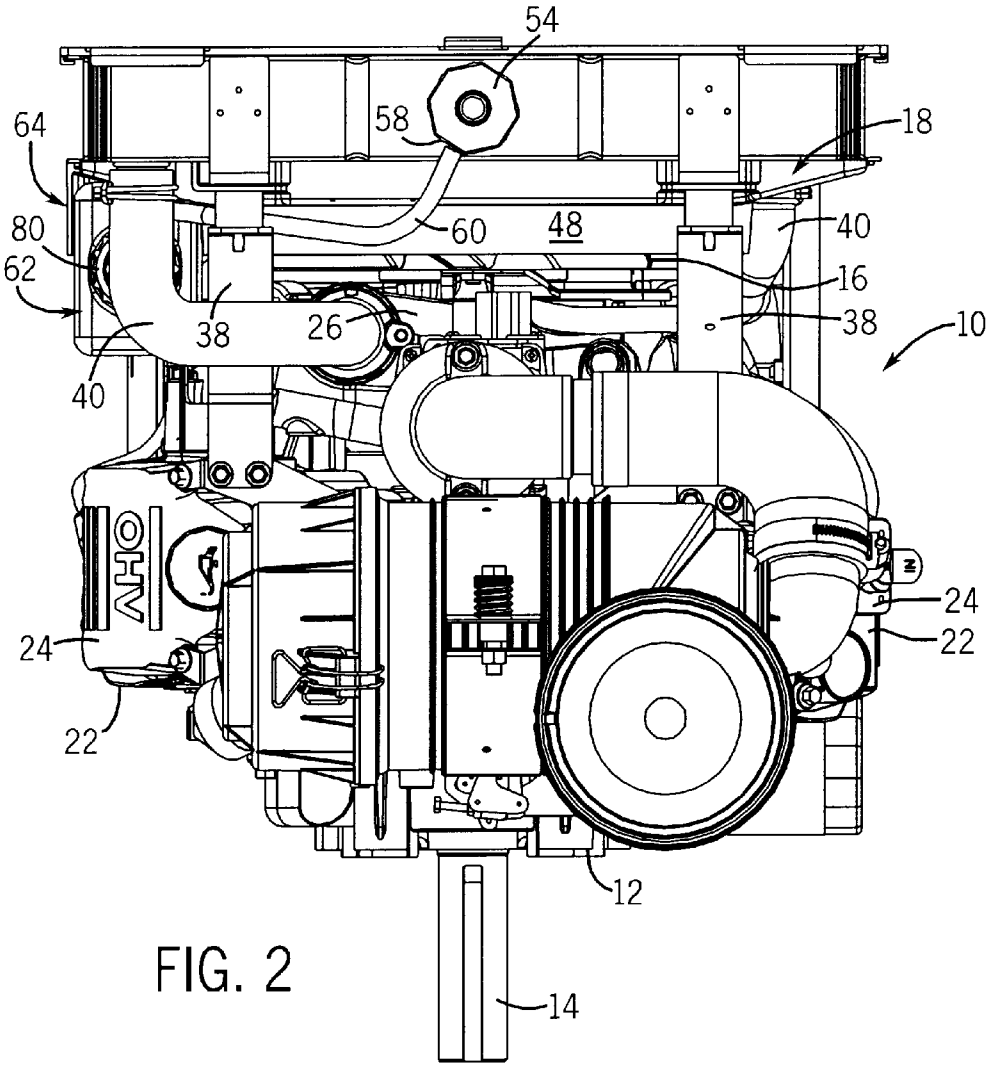
FIG. 2 is a top view of the internal combustion engine of FIG. 1.

Referring to FIGS. 1–3, the main elements of an internal combustion engine 10 include a cylinder block 12 with a rotatably mounted horizontal drive shaft 14 driving, among other things, a fan 16 disposed in a fan shroud 18 mounted to a radiator 20. The internal combustion engine 10 is cooled by liquid coolant, such as water, circulated through a cooling circuit including the radiator 20.

The cylinder block 12 has two cylinders 22 each having a head 24 disposed at one end. The cylinders 22 receive reciprocating pistons (not shown) which drive the drive shaft 14. Operation of the internal combustion engine 10 generates heat in the cylinders 22 which heats the entire cylinder block 12. To cool the cylinder block 12, the cooling circuit passes through and around the cylinder cylinders 22 and heads 24.

Passageways (not shown) in the cylinder block 12 form part of the cooling circuit which includes a manifold 26, thermostat valve (not shown), radiator 20 and a coolant pump (not shown). The cooling circuit defines a path for the coolant to flow through the engine 10 to take up and transfer heat for cooling the engine 10.

The coolant in the passageways is heated by the engine 10 and flows from the passageways into the manifold 26. The manifold 26 receives coolant from the passageways in the cylinders 22 and heads 24 and directs it past the thermostat valve. The heated coolant from all the passageways is combined in the manifold 26 to reduce pressure fluctuations in the cooling circuit generated from any particular passageway. The thermostat valve in the manifold 26 controls flow of coolant through the circuit in response to the engine temperature to maintain the operating temperature of the engine 10 within a desired range.

Referring to FIGS. 3 and 4, the radiator 20 is a conventional sort with a coolant vessel having a plurality of thin aluminum fins. The radiator 20 mounts the fan shroud 18 at a pair of tabs at its bottom having openings that receive pins 34 (see FIG. 5) extending downwardly from the fan shroud 18. The radiator 20 and fan shroud 18 are mounted to the engine 10 by a radiator bracket 36 supporting the bottom of the radiator 20 and a pair of extension brackets 38 each fastened at one end to the top of the cylinder block 12 and at the other end to the top of the radiator 20 and fan shroud 18 by threaded fasteners with rubber isolators. Radiator hoses 40 connect to inlet 42 and outlet 44 ports at diagonal corners of the radiator 20 to couple the radiator 20 to the cooling circuit in a closed path.

Air is forced through the radiator 20 by the fan 16 to cool the coolant in the cooling circuit. The fan 16 is coupled to the drive shaft 14 by suitable gearing or belts and has a plurality of cupped fan blades 46 spaced about its spin axis. The fan 16 is disposed in part within a flange 48 extending around the periphery of an opening 50 in the body 52 of the fan shroud 18. As the fan 16 rotates, the fan blades 46 draw cooling air from the atmosphere in a generally axial direction through the radiator 20. The peripheral flange 48 and the outward taper of the shroud body 52 aid in capturing the air currents generated by the fan 16 and dispersing them across the entire face of the radiator 20. Cooled coolant exits the radiator 20 through the outlet port 44 and passes through a radiator hose 40 to the coolant pump which circulates the coolant through the cooling circuit to cool the engine 10.

Referring to FIG. 4, as the coolant absorbs heat from the engine 10, it expands, thereby increasing the pressure in the cooling circuit. Excess pressure is relieved through a valve cap 54 covering a fill opening 56 of the radiator 20. The valve cap 54 has an overflow port 58 in communication with a vent tube 60. An overflow bottle 62 receives excess coolant and gas in the cooling circuit vented through the valve cap 54. Coolant can pass from the overflow bottle 62 back through the vent tube 60 into the radiator 20 when the pressure drops. When the engine 10 stops operating and the coolant temperature drops, a vacuum is created which draws coolant from the overflow bottle 62 back into the radiator 20.

Figure 5:
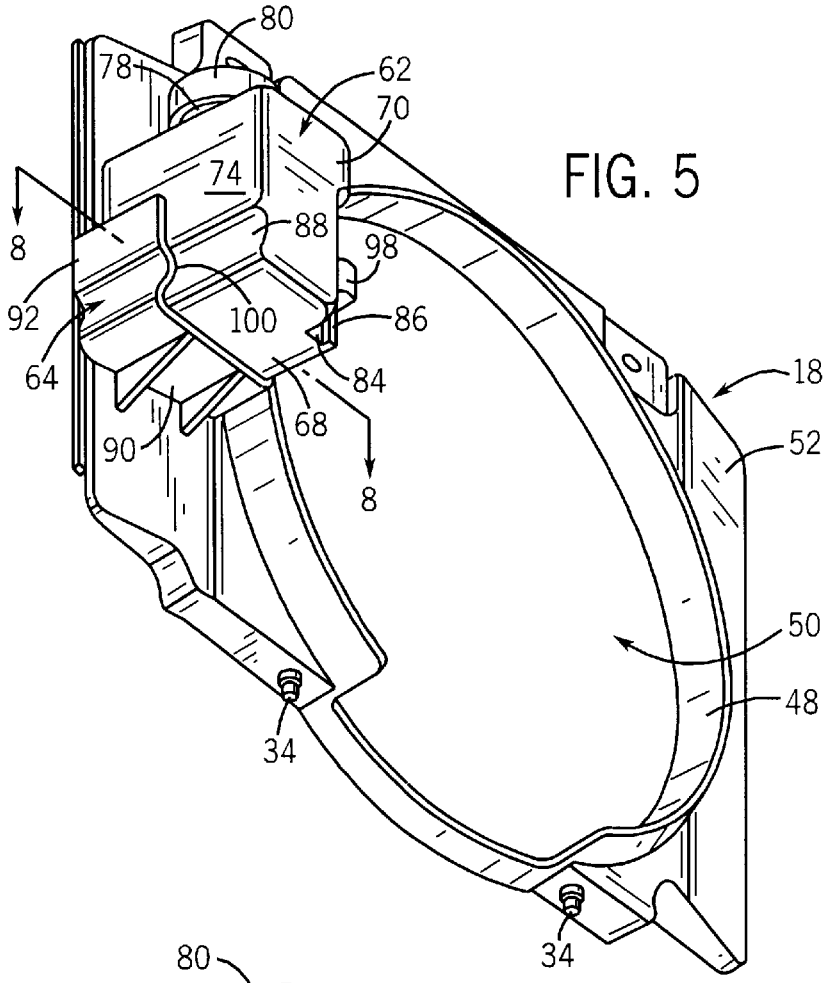
FIG. 5 is a perspective view of the fan shroud and overflow bottle.
Figure 7:
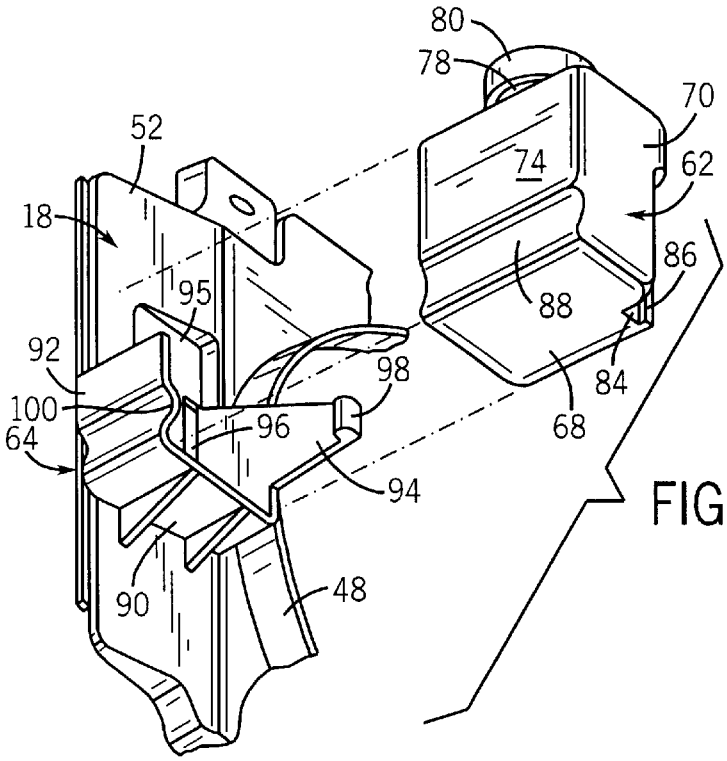
FIG. 7 is a partial perspective view of the fan shroud showing the overflow bottle removed from the bottle.
Figure 6:
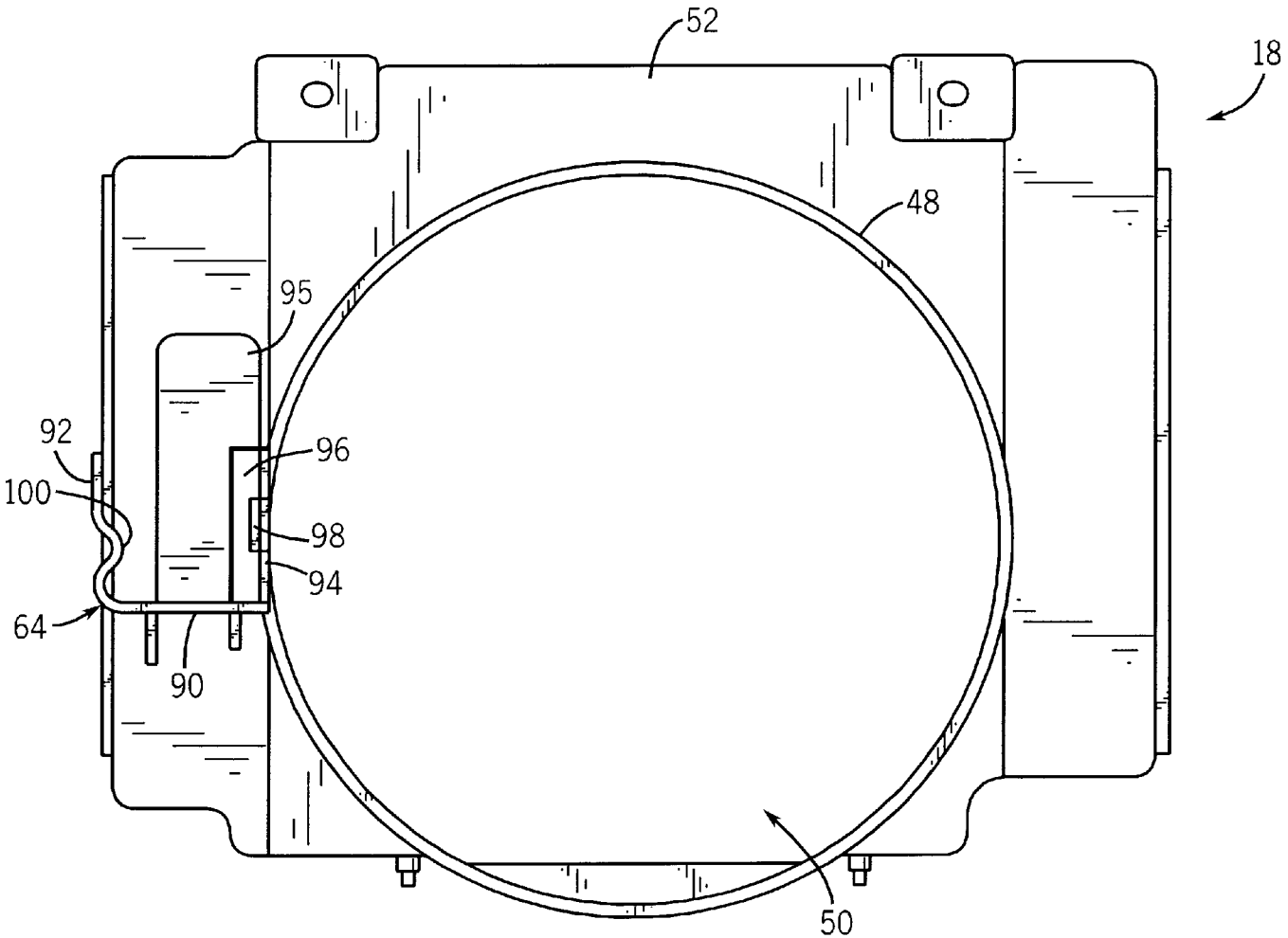
FIG. 6 is front view of the fan shroud.

Referring to FIGS. 5–7, the overflow bottle 62 is mounted to the fan shroud 18 at a bottle mount 64. Preferably, the fan shroud 18 is injection molded of a talc-filled polypropylene to include the bottle mount 64 as a unitary component thereof. The overflow bottle 62 is preferably blow molded of a suitable plastic to define surfaces for mounting to the bottle mount 64 of the fan shroud 18.

In one embodiment, the overflow bottle 62 has a top 66 and bottom 68 joined by side walls defining a front face 70, back face 72 and left 74 and right 76 side faces. The bottle top 68 has an opening 78 covered by a conventional overflow cap 80 with a vent port 82 in fluid communication with the vent tube 60 for passing coolant into and out of the overflow bottle 62. The overflow cap 74 can be connected to the neck of the overflow bottle 62 defining the opening 78 via a bayonet or other suitable connection. Although not shown, the overflow cap 80 can also have a small vent opening for releasing accumulated excess gas to the atmosphere. The front face 70 of the overflow bottle 62 defines a vertical catch groove 84 having a raised but recessed outer shoulder 86. The catch groove 84 extends along the right edge of the front face 70 and back into the right side face 76. The left side face 74 has a horizontal recess 88 extending from the front face 70 to the back faces 72. The catch groove 84 and recess 88 provide locations for engagement of the overflow bottle 62 to the bottle mount 64 of the fan shroud 18.

The bottle mount 64 is molded as a unitary part of the shroud body 52 and forms a cradle with a bottom 90 (supported by two gussets) and two side walls 92 and 94. One side wall 94 is a deflectable bottle clip in part formed by the peripheral flange 48 around the fan opening 50. The shroud body 52 is taped at the outer ends and thus is formed with a recess 95 (see FIGS. 6 and 7)to accommodate the back face 72 of the overflow bottle 62. A clearance void 96 in the recess 95 accommodates the die element forming a latch end 98 of the bottle clip 94. The bottle clip 94 extends substantially perpendicularly from the face of the shroud body 52 a sufficient distance so that the latch end 98 abuts the shoulder 86 of the catch groove 84 in the front face 70 of the overflow bottle 62 when it is pushed into the bottle mount 64 from the front and oriented with its back face 72 first. With reference to FIG. 8, as the overflow bottle 62 is inserted into the bottle mount 64, the right side face 76 will contact the latch end 98 and deflect the bottle clip 94 outward until the latch end 98 engages the catch groove shoulder 86. The bottle clip 94 engages the overflow bottle 62 by abutment of the back surface of the latch end 98 with the front surface of the catch groove shoulder 86. It should be noted, however, that the latch end 98 could be formed with a backwardly extending lip that is disposed within the catch groove 84 when the overflow bottle 62 is fully seated in the bottle mount 64.

Opposite the bottle clip 94 is the side wall 92 having an inwardly-directed, convex locking surface 100. The locking surface 100 mates with the concave, outwardly opening recess 88 in the left side face 74 of the overflow bottle 62 and prevents rotation of the overflow bottle 62 that may be caused by the downward force acting on the overflow bottle 62 from the bottle clip 94 so as to retain the overflow bottle 62 in the bottle mount 64. The overflow bottle 62 is thus retained in the bottle mount 64 in an upright position with the cap 80 at the top.

The overflow bottle 62 is thus easily mounted to the fan shroud 18 by snapping it into the bottle mount 64. The overflow bottle 62 can be detached from the fan shroud 18, to repair or replace it for example, by deflecting the bottle clip 94 outward so that the inwardly extending latch end 98 no longer abuts the shoulder 86 of the groove 84 in the overflow bottle 62. This can be accomplished easily without tools using one's thumb. With the bottle clip 94 disengaged from the overflow bottle 62, the overflow bottle 62 can be slid forward out of the bottle mount 64 and removed from the fan shroud 18 and thereby the engine 10.

The invention thus provides a one-piece fan shroud and bottle mount for securing a specially designed overflow bottle accommodating excess engine coolant. The overflow bottle can be easily installed and removed from the shroud without tools. No assembly is required for the mount to the fan shroud and the overflow bottle can simply be snapped into the bottle mount to secure it to the fan shroud in an upright position. The fan shroud is mounted to the radiator such that the bottle mount (and thus the overflow bottle) is close to the radiator fill opening, thus reducing overflow tubing.

A preferred embodiment of the invention has been described in particular detail. Many modifications and variations to the described embodiment will be apparent to those skilled in the art. Therefore, the invention is not limited by the description but should be defined by the claims which follow.

What is claimed is:

1. In a liquid cooled internal combustion engine having a fan, a radiator containing coolant fluid pumped through a cooling circuit for cooling heat generating components of the engine, and a fan shroud disposed about the fan to direct air from the fan to the radiator for cooling the coolant, the improvement wherein the fan shroud includes a unitary bottle mount detachably mounting an overflow bottle that is connectible to the radiator to receive coolant, wherein the bottle mount includes a bottle clip with a latch end for engaging the overflow bottle in a snap fit and wherein one side of the bottle mount has an inwardly projecting convex locking surface for retaining the overflow bottle in the bottle mount.

2. The improvement of claim 1, wherein the fan shroud includes a void adjacent the bottle clip.

3. The improvement of claim 1, wherein the bottle mount defines a cradle with a bottom and spaced sides for supporting the bottom and sides of the overflow bottle.

4. The improvement of claim 3, wherein the fan shroud further includes an opening for receiving the fan, wherein the opening has a flange along at least a portion of its periphery.

5. The improvement of claim 4, wherein one of the sides of the bottle mount is in part formed by the flange.

6. The improvement of claim 1, wherein the fan shroud forms a recess at the bottle mount sized to accommodate a portion of the overflow bottle.

7. The improvement of claim 1, wherein the fan shroud is tapered at its ends.

8. The improvement of claim 1, wherein the fan shroud and bottle mount are molded from polypropylene.

9. A coolant bottle for use in an internal combustion engine having a fan, a radiator containing coolant fluid for cooling heat generating components of the engine, and a fan shroud disposed about the fan to direct air from the fan to the radiator for cooling the coolant, the coolant bottle being constructed to snap into a bottle mount of the fan shroud so as to be detachably mounted to the fan shroud, wherein the coolant bottle has a bottom joined to a top by side walls defining front, back and opposite side faces and wherein the front face includes a catch recess sized to engage a clip of the bottle mount.

10. The coolant bottle of claim 9, wherein one of the side faces includes a recess extending from the front face to the back face for engaging a locking feature of the bottle mount.

* * * * *